US010989225B2

(12) United States Patent
Kimura

(10) Patent No.: US 10,989,225 B2
(45) Date of Patent: Apr. 27, 2021

(54) VACUUM PUMP

(71) Applicant: SHIMADZU CORPORATION, Kyoto (JP)

(72) Inventor: Hiroaki Kimura, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 16/890,160

(22) Filed: Jun. 2, 2020

(65) Prior Publication Data

US 2020/0291963 A1 Sep. 17, 2020

Related U.S. Application Data

(63) Continuation of application No. 15/674,560, filed on Aug. 11, 2017, now abandoned.

(30) Foreign Application Priority Data

Aug. 29, 2016 (JP) ..... 2016-166990

(51) Int. Cl.
*F04D 29/66* (2006.01)
*F04D 19/04* (2006.01)
*F04D 29/26* (2006.01)

(52) U.S. Cl.
CPC ..... *F04D 29/662* (2013.01); *F04D 19/042* (2013.01); *F04D 29/266* (2013.01)

(58) Field of Classification Search
CPC ..... F04D 29/66; F04D 29/661; F04D 29/662; F04D 19/04; F04D 19/042; F04D 19/044; F04D 29/266; F16C 2360/45
See application file for complete search history.

(56) References Cited

U.S. PATENT DOCUMENTS 3,877,546 A 4/1975 Shrader
5,217,346 A * 6/1993 Ikegami ..... F04D 19/04 415/55.1
6,755,611 B1 6/2004 Kabasawa
6,890,145 B2 5/2005 Takamine
7,354,254 B2 * 4/2008 Gotta ..... F04D 19/046 417/201
7,645,126 B2 * 1/2010 Sekiguchi ..... F04D 17/168 417/423.4

(Continued)

FOREIGN PATENT DOCUMENTS

CN 108474383 A 8/2018
JP 2001059496 A 3/2001

(Continued)

OTHER PUBLICATIONS

Second Office Action for corresponding Chinese Application No. 2017105333353 dated Sep. 20, 2019, with English language translation.

(Continued)

*Primary Examiner* — Courtney D Heinle
*Assistant Examiner* — Andrew Thanh Bui
(74) *Attorney, Agent, or Firm* — Renner, Otto, Boisselle & Sklar, LLP

(57) ABSTRACT

A vacuum pump comprises: a pump rotor rotatably driven by a motor and fastened to a shaft; a recessed portion formed at a suction-port-side end surface of the pump rotor; and a rotor balance correction member including a cover portion configured to cover the recessed portion.

10 Claims, 11 Drawing Sheets

(56) References Cited

U.S. PATENT DOCUMENTS

| | | | | |
|---|---|---|---|---|
| 9,512,853 | B2 * | 12/2016 | Bottomfield | F04D 19/042 |
| 9,976,572 | B2 | 5/2018 | Kogame | |
| 2004/0265152 | A1 | 12/2004 | Gotta et al. | |
| 2014/0271174 | A1 | 8/2014 | Bottomfield | |
| 2014/0369809 | A1 | 12/2014 | Beyer | |
| 2019/0032669 | A1 | 1/2019 | Kawanishi | |

FOREIGN PATENT DOCUMENTS

| | | | |
|---|---|---|---|
| JP | 2003-148389 | A | 5/2003 |
| JP | 2008144695 | A | 6/2008 |
| JP | 2014055574 | A | 3/2014 |

OTHER PUBLICATIONS

First Office Action for corresponding Japanese Application No. 2016-166990 dated Sep. 26, 2019, with English language translation.

Office Action for corresponding Chinese Application No. 2017105333353, dated Feb. 1, 2019.

Office Action for corresponding Japanese Application No. 2016-166990, dated Mar. 30, 2020.

Third Office Action for corresponding Chinese Application No. 2017105333353 dated Jun. 8, 2020, with English language translation.

* cited by examiner

1

VACUUM PUMP

BACKGROUND OF THE INVENTION

1. Technical Field

The present invention relates to a vacuum pump.

2. Background Art

Typically, a rotor of a turbo-molecular pump is, using a fastening member such as a bolt, fastened to a shaft as a rotor shaft (see, e.g., Patent Literature 1, Japanese Patent No. 3974772). In a turbo-molecular pump described in Patent Literature 1, a recessed portion is formed at a suction-port-side end surface of a rotor, and a bottom portion of the recessed portion is bolt-fastened to a shaft.

In the case of using, as an exhaust pump of a semiconductor manufacturing device such as an etching device, a vacuum pump such as a turbo-molecular pump, particles generated due to a chemical change in a process gas component upon discharge of process gas flow into the vacuum pump through a suction port. As described above, in the case where a recessed portion is formed at a suction-port-side end surface of a rotor, the particles tend to accumulate in the recessed portion. When gas inflow into a semiconductor manufacturing device chamber is adjusted such that the internal pressure of the chamber repeatedly increases/decreases, the particles accumulated in the recessed portion rebound toward the chamber. As a result, this leads to lowering of a quality in semiconductor manufacturing.

SUMMARY OF THE INVENTION

A vacuum pump comprises: a pump rotor rotatably driven by a motor and fastened to a shaft; a recessed portion formed at a suction-port-side end surface of the pump rotor; and a rotor balance correction member including a cover portion configured to cover the recessed portion.

A rotor-axial position of the cover portion is set between a position at which an outer surface of the cover portion is coincident with an edge of an inner wall of the recessed portion and a position at which an inner surface of the cover portion is coincident with the suction-port-side end surface of the pump rotor.

The pump rotor has an inclined surface having an ascending gradient and connecting between the edge of the inner wall of the recessed portion and the suction-port-side end surface of the pump rotor.

The rotor balance correction member includes a first component having a first balance correction portion disposed in the recessed portion, and a second component provided with the cover portion.

The cover portion includes a second balance correction portion.

The first component includes a third correction portion disposed on an outer peripheral side of the cover portion to cover a portion of the recessed portion and having both of a cover function and a balance correction function.

The first component, the pump rotor, and the shaft are fastened together with a bolt, and the second component is fixed to the first component.

The shaft penetrates the pump rotor to protrude into the recessed portion, and the rotor balance correction member is fixed to a portion of the shaft protruding into the recessed portion.

The shaft penetrates the pump rotor to protrude into the recessed portion, and the second component is fixed to a portion of the shaft protruding into the recessed portion.

The vacuum pump further comprises: a communication path connecting between the recessed portion and an external space of the cover portion.

According to the present invention, rebounding of particles into a semiconductor device chamber can be reduced.

DETAILED DESCRIPTION OF THE EXEMPLARY EMBODIMENTS

Figure 1:
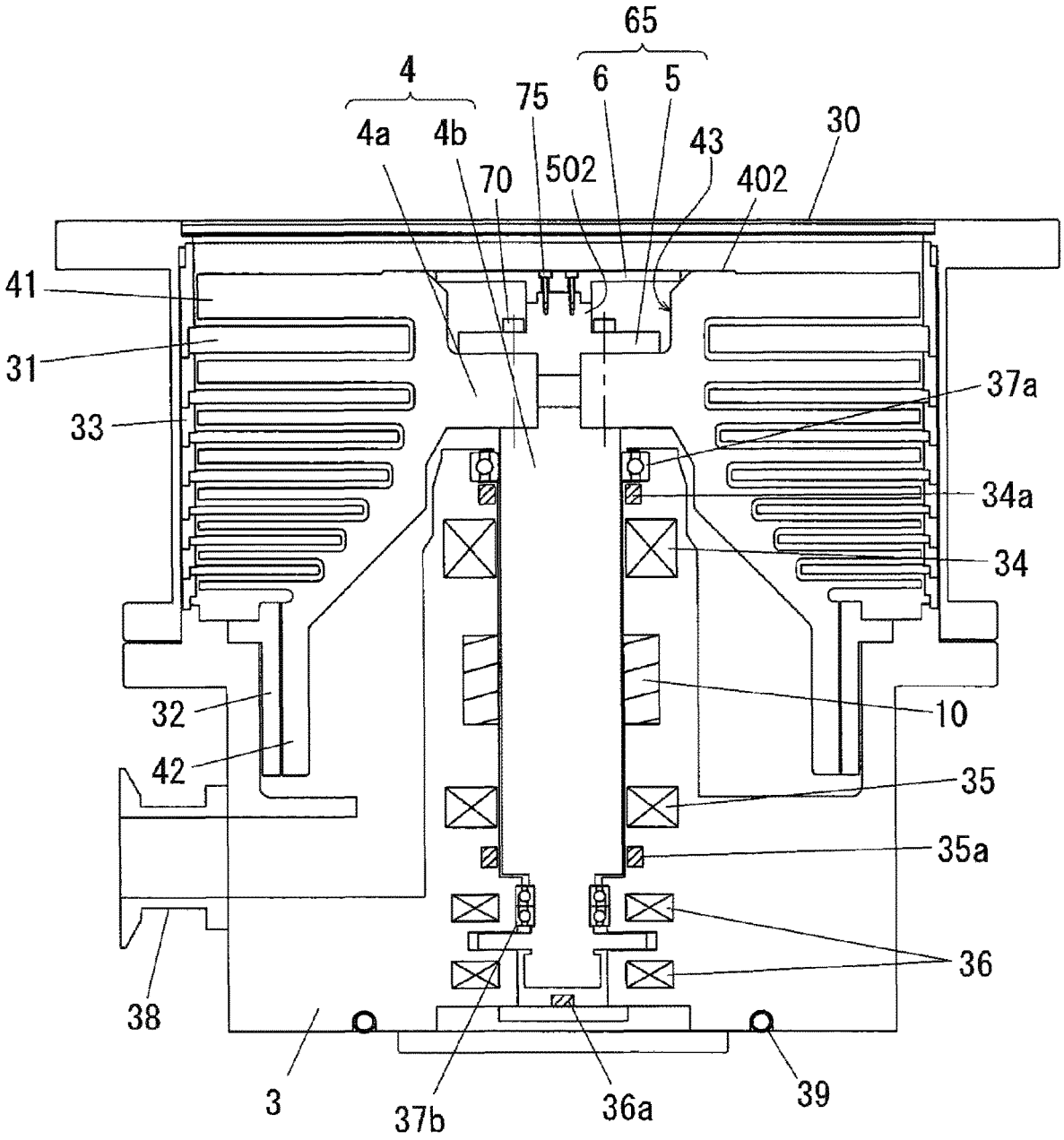
FIG. 1 is a view of one embodiment of a vacuum pump of the present invention.

Hereinafter, embodiments of the present invention will be described with reference to the drawings. FIG. 1 is a view of one embodiment of a vacuum pump of the present invention, and is a cross-sectional view of an outline configuration of a turbo-molecular pump 1.

The turbo-molecular pump 1 includes a turbo pump stage having rotor blades 41 and stationary blades 31, and a screw groove pump stage having a cylindrical portion 42 and a stator 32. In the screw groove pump stage, a screw groove is formed at the stator 32 or the cylindrical portion 42. The rotor blades 41 and the cylindrical portion 42 are formed at a pump rotor 4*a*. The pump rotor 4*a* is bolt-fastened to a shaft 4*b*. The pump rotor 4*a* and the shaft 4*b* form a rotor unit 4.

The stationary blades 31 and the rotor blades 41 are alternately arranged in an axial direction. The stationary blades 31 are stacked on each other with a spacer ring 33 being interposed between adjacent ones of the stationary blades 31 in a pump axial direction. The shaft 4*b* is supported by radial electromagnets 34, 35 and axial electromagnets 36 provided at a base 3 in a non-contact manner. Displacement from a target levitation position of the shaft 4*b* is detected by gap sensors 34*a*, 35*a*, 36*a*.

The rotor unit 4 is rotatably driven by a motor 10. When the magnetic bearings are not in operation, the shaft 4*b* is supported by emergency mechanical bearings 37*a*, 37*b*. When the rotor unit 4 is rotated at high speed by the motor 10, gas molecules taken in through a pump suction port 30 are sequentially exhausted by the turbo pump stage (the rotor blades 41, the stationary blades 31) and the screw groove pump stage (the cylindrical portion 42, the stator 32), and then, are discharged through an exhaust port 38. The base 3 is provided with a coolant water pipe 39 for base cooling.

A recessed portion 43 is formed at a pump-suction-port-side end surface 402 of the pump rotor 4*a*. A balance correction member 65 is provided at the recessed portion 43. The balance correction member 65 includes a cover portion 6 configured to cover the recessed portion 43, and a balance ring 5 for balance correction. The cover portion 6 is, with bolts 75, fixed to a boss portion 502 of the balance ring 5 such that the cover portion 6 and the balance ring 5 are integrated together as the balance correction member 65. The balance ring 5 and the pump rotor 4*a* are fastened together to the shaft 4*b* with bolts 70.

Figure 2:
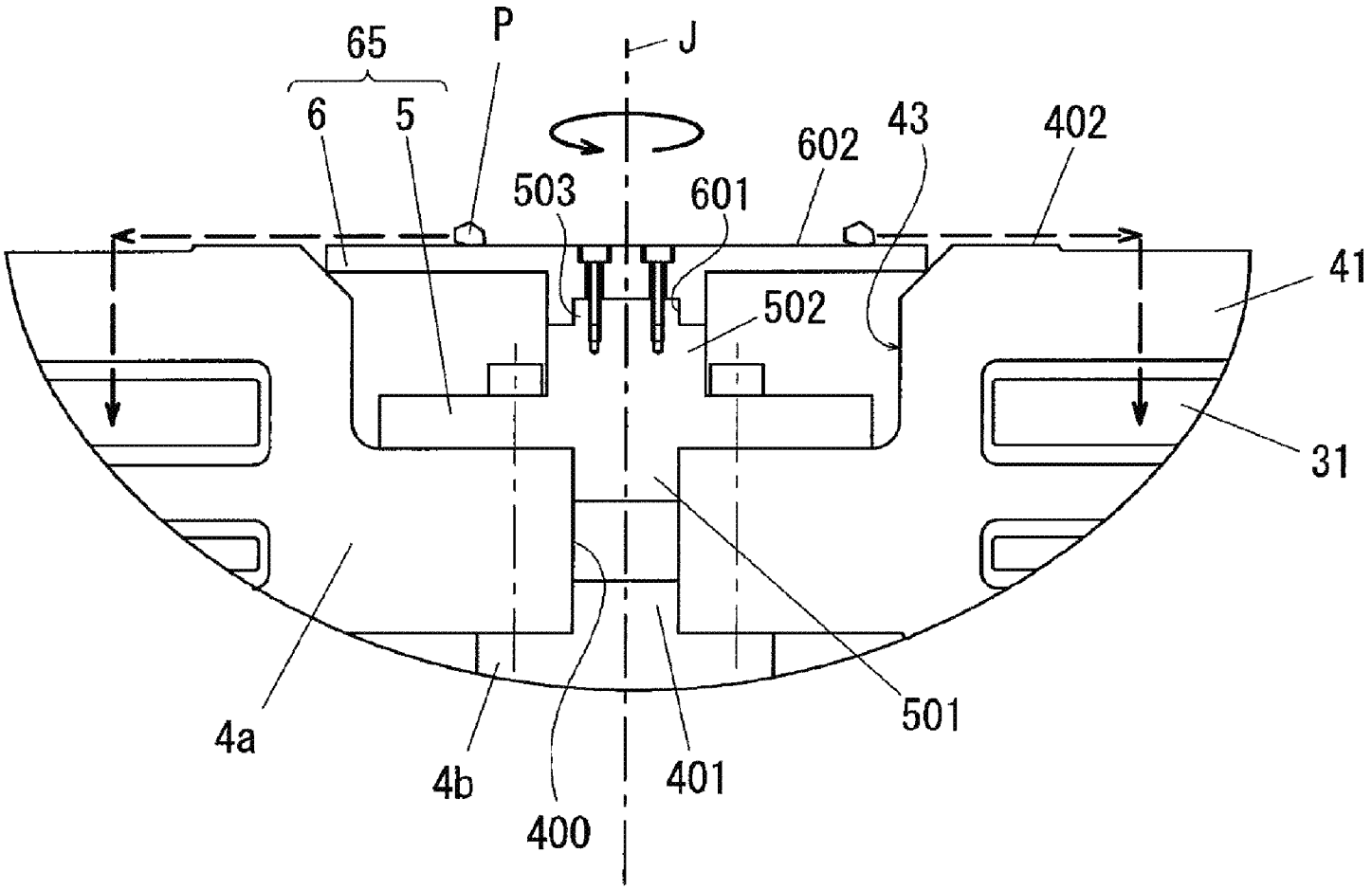
FIG. 2 is a partial enlarged view of a recessed portion of a pump rotor.

FIG. 2 is a partial enlarged view of the recessed portion 43 of the pump rotor 4*a*. A boss portion 401 formed at the top of the shaft 4*b* and a boss portion 501 formed on a back side of the balance ring 5 are inserted into a through-hole 400 formed at a bottom surface of the recessed portion of the pump rotor 4*a*. Moreover, a raised portion 503 is formed at the top of the boss portion 502 of the balance ring 5, and is fitted into a recessed portion 601 formed on a back side of the cover portion 6 such that the cover portion 6 is positioned. The height (the axial position) of an outer surface 602 of the cover portion 6 will be described later.

Since the recessed portion 43 is covered with the cover portion 6, particles P taken in through the pump suction port 30 (see FIG. 1) are dropped onto the pump-suction-port-side end surface 402 of the pump rotor 4*a* and the outer surface 602 of the cover portion 6. Since the rotor unit 4 of the turbo-molecular pump 1 rotates at high speed, the particles P dropped onto the end surface 402 and the outer surface 602 move, due to the centrifugal force, apart from a rotation axis J in a direction toward a tip end of the rotor blade 41. The particles P having moved to the rotor blade 41 move toward a pump downstream side through the rotor blades 41 and the stationary blades 31. Thus, accumulation of the particles P at the end surface of the pump rotor 4*a* can be prevented, and rebounding of the particles P into a semiconductor device chamber can be prevented when the internal pressure of the chamber increases/decreases.

Figure 3A:
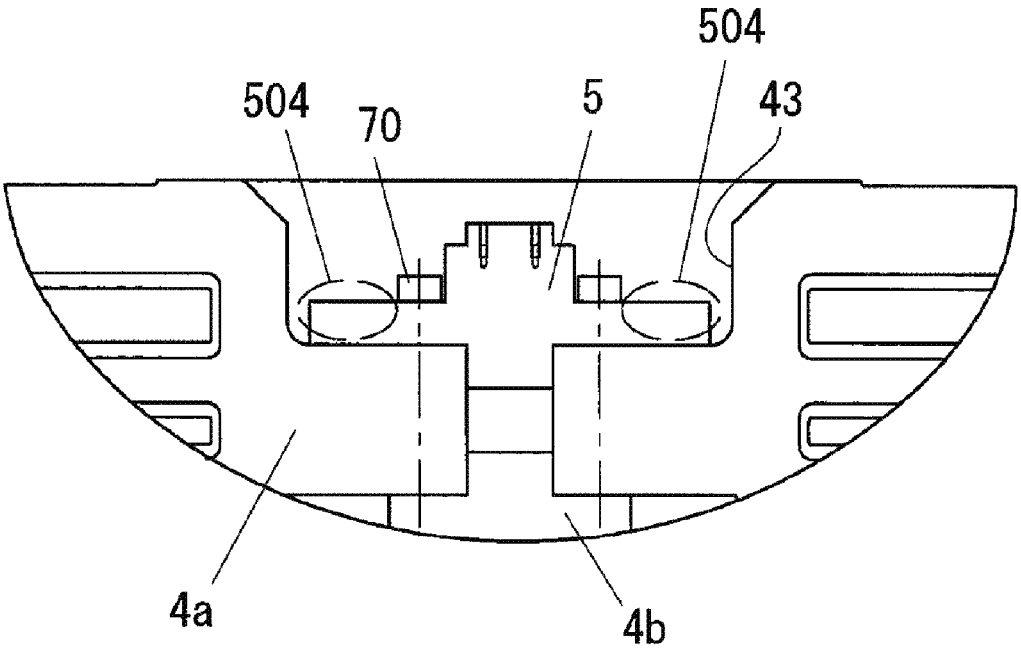
FIGS. 3A and 3B are views for describing the steps of assembling a balance ring and a cover portion and a balance adjustment method.
Figure 3B:
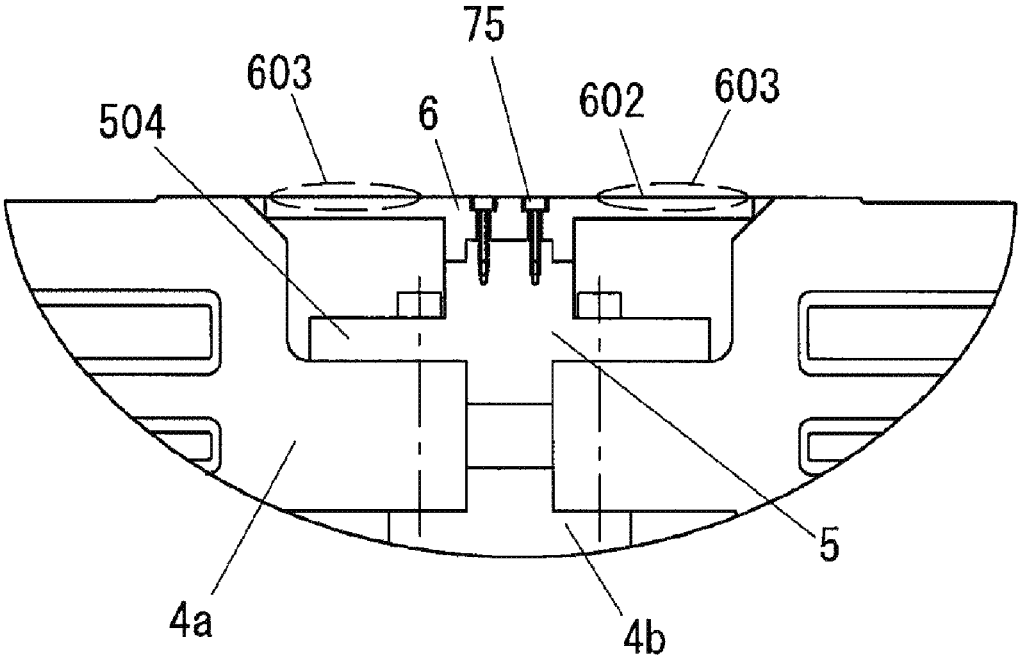

Since the rotor unit 4 rotates at high speed as described above, balance adjustment is important. FIGS. 3A and 3B are views for describing the steps of assembling the balance ring 5 and the cover portion 6 and a balance adjustment method. At a first step, the pump rotor 4*a* and the balance ring 5 are fastened together to the shaft 4*b* with the bolts 70 as shown in FIG. 3A. In this manner, the pump rotor 4*a* and the shaft 4*b* are integrated together, and the balance ring 5 is fixed to the bottom surface of the recessed portion of the pump rotor 4*a*.

At a second step, an unbalance amount of the rotor unit 4 is measured by a rotation testing machine with the cover portion 6 being not attached. When the measured unbalance amount exceeds an acceptable value, a portion of a correction portion 504 of the balance ring 5 is cut off with, e.g., a drill to reduce the unbalance amount. Conversely, unbalance may be corrected in such a manner that, e.g., the mass of a locking screw is added to the correction portion 504.

At a third step, the cover portion 6 is fixed to the balance ring 5 as illustrated in FIG. 3B, and the unbalance amount of the rotor unit 4 is measured by the rotation testing machine. When the measured unbalance amount exceeds the acceptable value, a portion of the outer surface 602 of the cover portion 6 is cut off to reduce the unbalance amount. Note that a region close to the edge of the cover portion 6 is set as a correction portion 603, i.e., a portion to be cut off. The mass of the cover portion 6 is extremely smaller than the entire mass of the rotor unit. For this reason, off-balance due to attachment of the cover portion 6 is small, and a cut-off amount when exceeding the acceptable value is extremely smaller than that at the second step. Thus, the thickness of the correction portion 603 can be thinner than that of the correction portion 504 of the balance ring 5.

Typically, the pump rotor 4*a* is made of aluminum alloy, and anti-corrosion treatment is performed for a turbo-molecular pump for the purpose of a semiconductor device application. For example, the anti-corrosion treatment is performed using, e.g., nickel plating. In this case, the above-described first and second steps are performed before plating. Note that a corrosion-resistance metal material such as stainless steel is used for the balance ring 5 and the cover portion 6. After balance correction at the second step, plating is performed for the pump rotor 4*a*. After plating, the cover portion 6 is fixed to the balance ring 5 with the pump rotor 4*a* being assembled with the shaft 4*b*. Subsequently, balance correction is performed for the rotor unit 4 as in the case of the above-described third step.

Figure 4A:
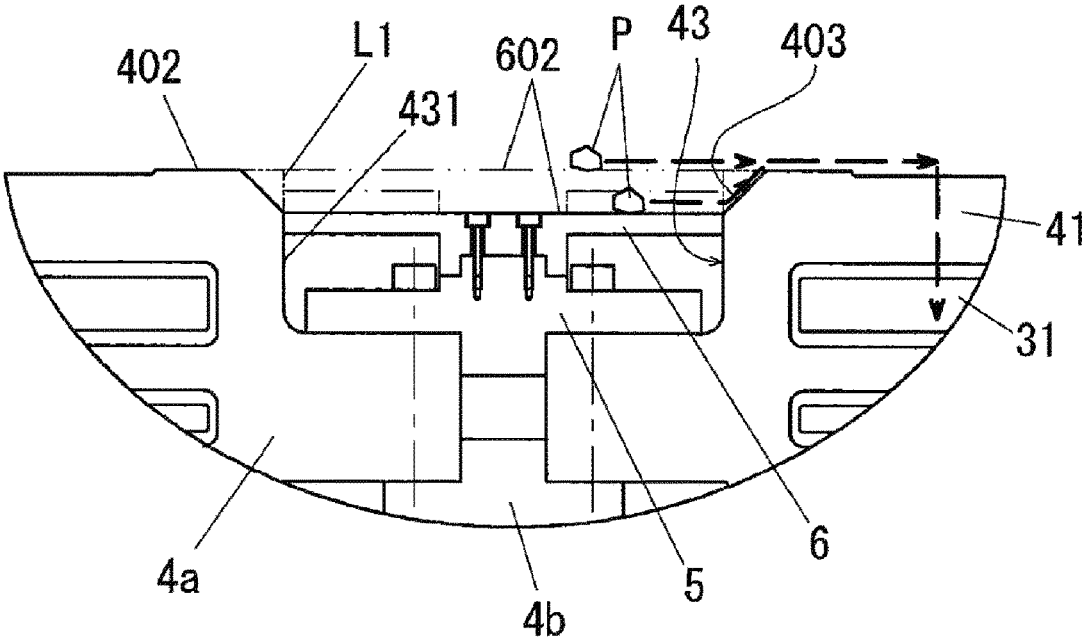
FIGS. 4A and 4B are views for describing the axial position of the cover portion.
Figure 4B:
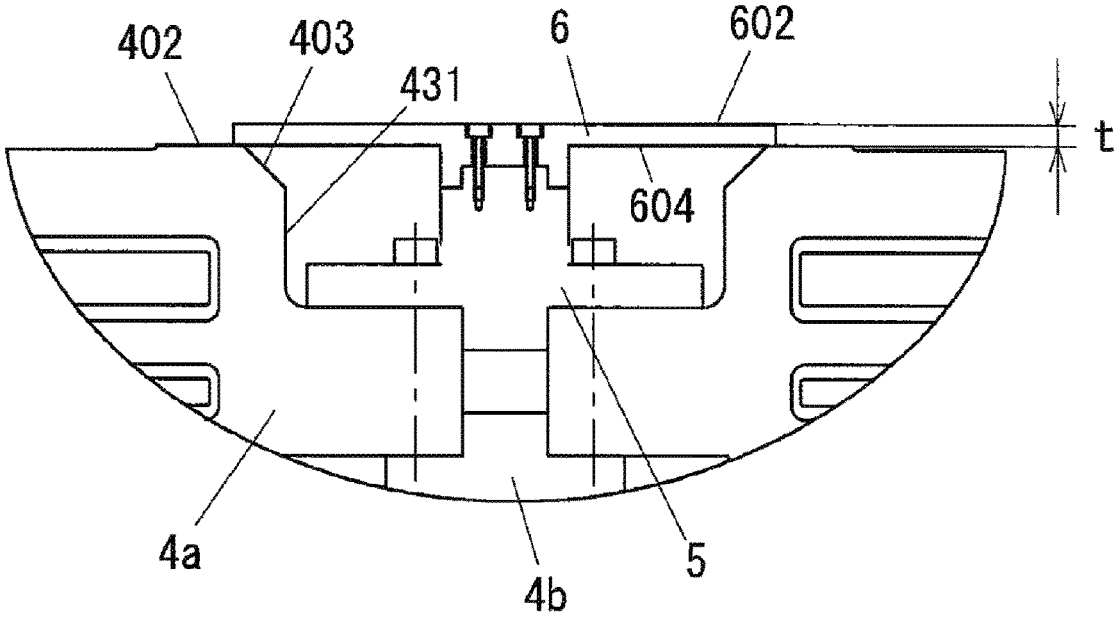

FIGS. 4A and 4B are views for describing the axial position of the cover portion 6. FIG. 4A is the view for describing the lower limit of the axial position of the cover portion 6. The lower position of the outer surface 602 of the cover portion 6 is set at a position coincident with the edge of an inner wall 431 of the recessed portion 43. The pump rotor 4*a* is provided with an inclined surface 403 connecting between the edge (an upper end) of the inner wall 431 of the recessed portion 43 and the pump-suction-port-side end surface 402. That is, the edge of the recessed portion 43 is chamfered. In this case, the edge of the inner wall 431 serves as a lower end of the inclined surface 403.

The particles P on the outer surface 602 move up to the end surface 402 on the inclined surface 403 as indicated by dashed arrows, and then, move to the rotor blade 41. Subsequently, the particles P are exhausted. Thus, the gradient of the inclined surface 403 is preferably small so that the particles P can easily move over the inclined surface 403.

On the other hand, in the case where the edge of the recessed portion 43 is not chamfered as indicated by a chain double-dashed line L1 or the case where a chamfered portion is extremely small, the lower position of the height of the cover portion 6 is, in terms of the axial position, set such that the outer surface 602 and the end surface 402 are coincident with each other.

FIG. 4B is the view for describing the upper limit of the axial position of the cover portion 6. For reducing a pump size, the axial height of the rotor unit 4 is preferably as small as possible. For this reason, the upper position of the cover portion 6 is preferably a position when an inner surface 604 of the cover portion 6 contacts the end surface 402. On this point, the axial position of the outer surface 602 of the cover portion 6 is a value obtained by addition of the thickness dimension t of the cover portion 6 to the axial position of the end surface 402.

(First Variation)

Figure 5:
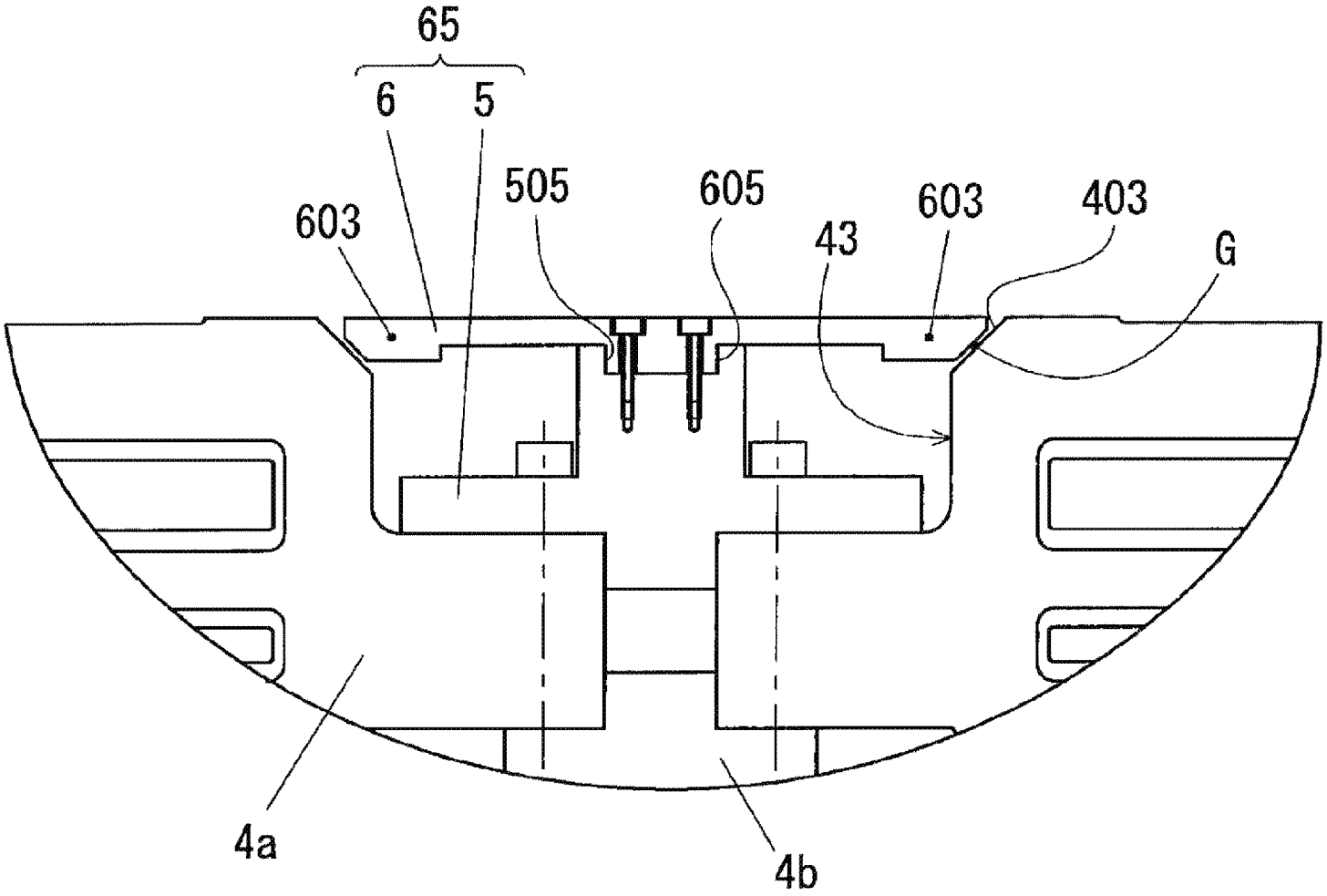
FIG. 5 is a view of a first variation of the present embodiment.

FIG. 5 is a view of a first variation of the present embodiment. As described with reference to FIGS. 3A and 3B, balance adjustment is performed even after the cover portion 6 has been attached to the balance ring 5. When the unbalance amount exceeds the reference value, the correction portion 603 of the cover portion 6 is cut off for balance correction. Thus, in the first variation illustrated in FIG. 5, the thickness of the correction portion 603 is increased such that an extra margin of correction increases.

Moreover, at a fastening portion between the balance ring 5 and the cover portion 6, a raised portion 605 is formed at the cover portion 6, and a recessed portion 505 is formed at the balance ring 5. Note that a clearance G is formed between the inclined surface 403 and the correction portion 603 of the cover portion 6. A space of the recessed portion 43 and an external space communicate with each other through the clearance G. When the space of the recessed portion 43 is closed, such a space serves as an air pocket. For this reason, gas in the recessed portion 43 gradually leaks upon vacuum pumping, leading to an adverse effect on vacuum environment. However, the clearance G formed as illustrated in FIG. 5 allows gas in the recessed portion 43 to be promptly exhausted upon vacuum pumping. Thus, the above-described problem is not caused. Note that a though-hole may be formed at the cover portion 6 instead of forming the clearance G.

(Second Variation)

Figure 6A:
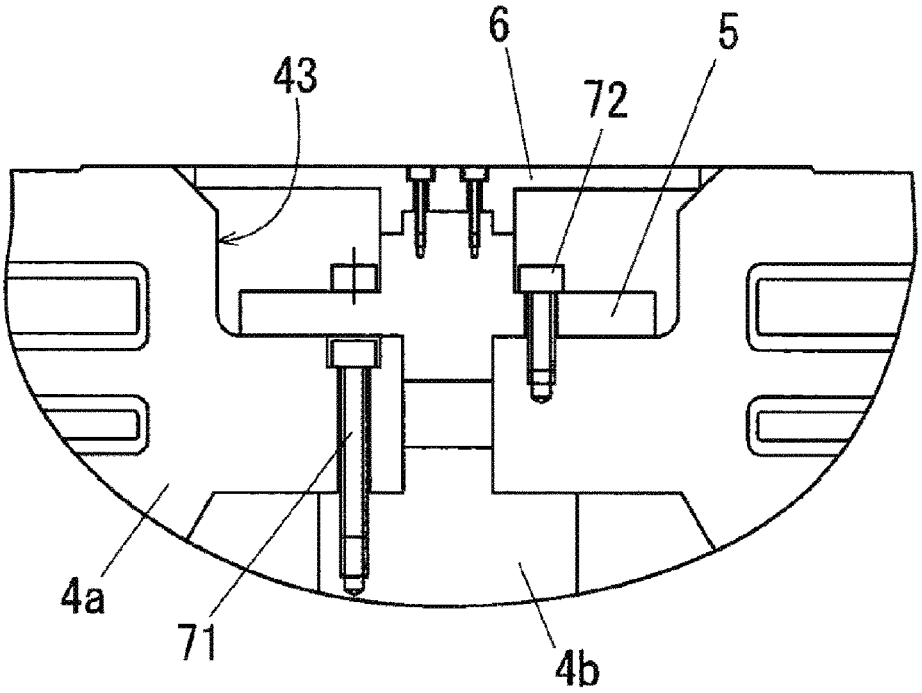
FIGS. 6A and 6B are views of a second variation of the present embodiment.
Figure 6B:
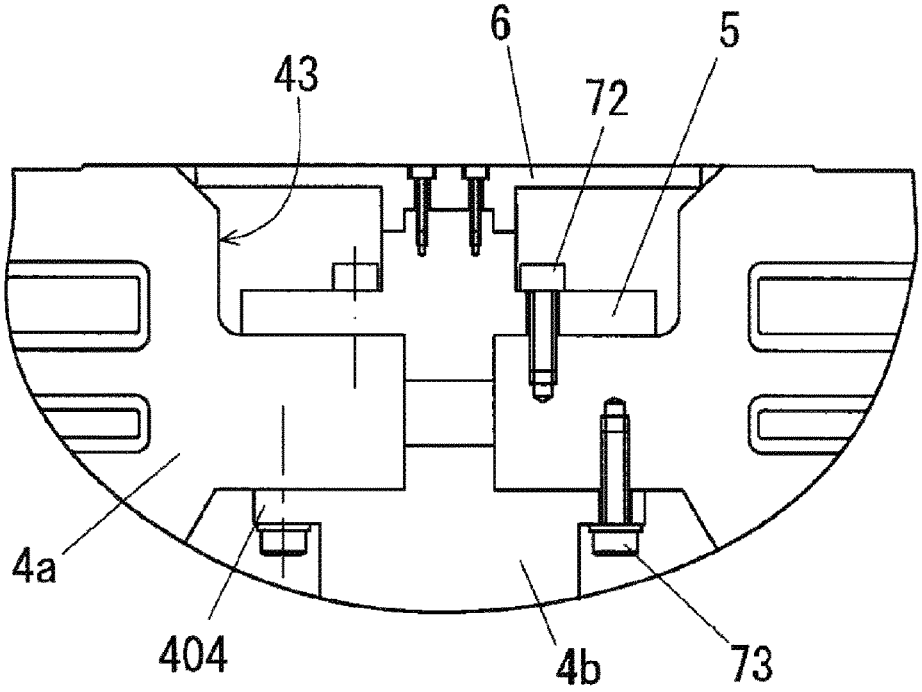

FIGS. 6A and 6B are views of a second variation of the present embodiment. In the embodiment illustrated in FIG. 2, it is configured such that the pump rotor 4*a* and the balance ring 5 are integrally fastened together to the shaft 4*b* with the bolts 70. On the other hand, in a configuration illustrated in FIG. 6A, the pump rotor 4*a* and the shaft 4*b* are fastened together with a bolt 71, and the pump rotor 4*a* and the balance ring 5 are fastened together with a bolt 72. In any case, bolt fastening is performed from a side close to the recessed portion 43. On the other hand, in a configuration illustrated in FIG. 6B, a flange 404 is formed at the shaft 4*b*, and using a bolt 73, is fastened to the pump rotor 4*a*. Fastening of the bolt 73 is performed from a shaft side (the lower side as viewed in the figure).

(Third Variation)

Figure 7:
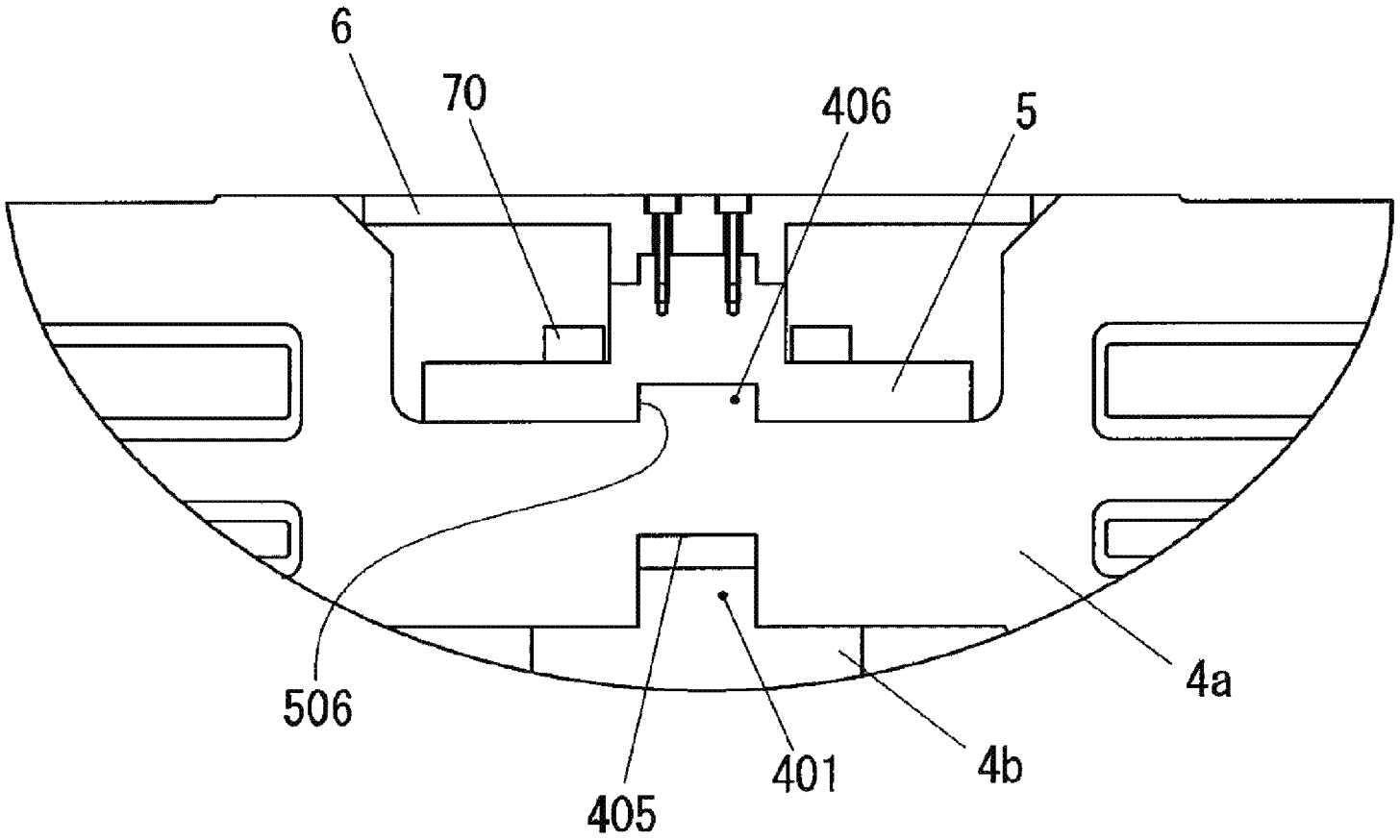
FIG. 7 is a view of a third variation of the present embodiment.

FIG. 7 is a view of a third variation of the present embodiment. In the embodiment illustrated in FIG. 2, it is configured such that the boss portion 401 of the shaft 4*b* and the boss portion 501 of the balance ring 5 are fitted into the through-hole 400 of the pump rotor 4*a*. On the other hand, in a configuration illustrated in FIG. 7, the pump rotor 4*a* is provided with a recessed portion 405 for shaft fastening and a boss portion 406 for balance ring fastening. Moreover, a recessed portion 506 to be fitted onto the boss portion 406 is formed on the back side of the balance ring 5. The pump rotor 4*a*, the shaft 4*b*, and the balance ring 5 are integrated together in the following manner: the boss portion 401 of the shaft 4*b* is fitted into the recessed portion 405, and the boss portion 406 of the pump rotor 4*a* is fitted into the recessed portion 506 of the balance ring 5; and then, fastening with the bolts 70 is performed.

(Fourth Variation)

Figure 8:
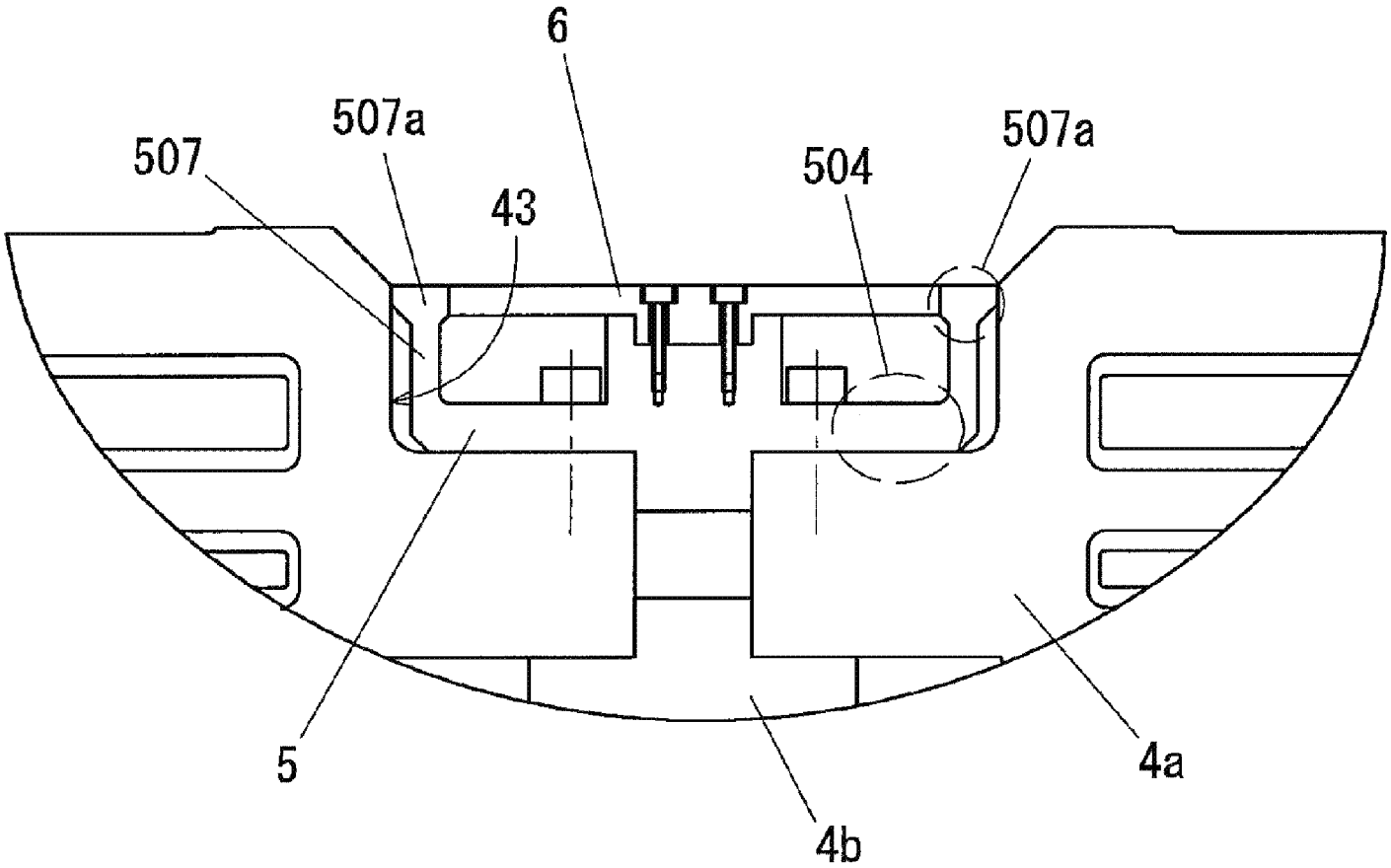
FIG. 8 is a view of a fourth variation of the present embodiment.

FIG. 8 is a view of a fourth variation of the present embodiment. Unlike the balance ring 5 illustrated in FIG. 2, the outer diameter dimension of the cover portion 6 varies, in a configuration illustrated in FIG. 8, according to the configuration of the balance ring 5. As described with reference to FIGS. 3A and 3B, in a balance adjustment process, balance correction is performed using the balance ring 5 before attachment of the cover portion 6, and is performed again by cutting off of the cover portion 6 after attachment of the cover portion 6. In the fourth variation, it is configured such that both of these types of balance correction are performed using only the balance ring 5.

At the balance ring 5, a standing portion 507 extending in an opening direction of the recessed portion 43 is formed at an outer peripheral portion of the correction portion 504, and a correction portion 507*a* is provided at a tip end of the standing portion 507. The correction portion 507*a* is disposed on an outer peripheral side of the cover portion 6, and the correction portion 507*a* and the cover portion 6 together cover a portion of the recessed portion 43. That is, the correction portion 507*a* has a balance correction function and a cover function.

In balance correction before attachment of the cover portion 6, a portion of the correction portion 504 of the balance ring 5 is cut off with, e.g., the drill as in the case illustrated in FIG. 3A. In balance correction after attachment of the cover portion 6, balance correction is performed in such a manner that a portion of the correction portion 507*a* is cut off with, e.g., the drill. In the case of this configuration, a cutting margin for balance correction is not necessarily provided at the cover portion 6, and therefore, the thickness of the cover portion 6 can be decreased.

(Fifth Variation)

Figure 9A:
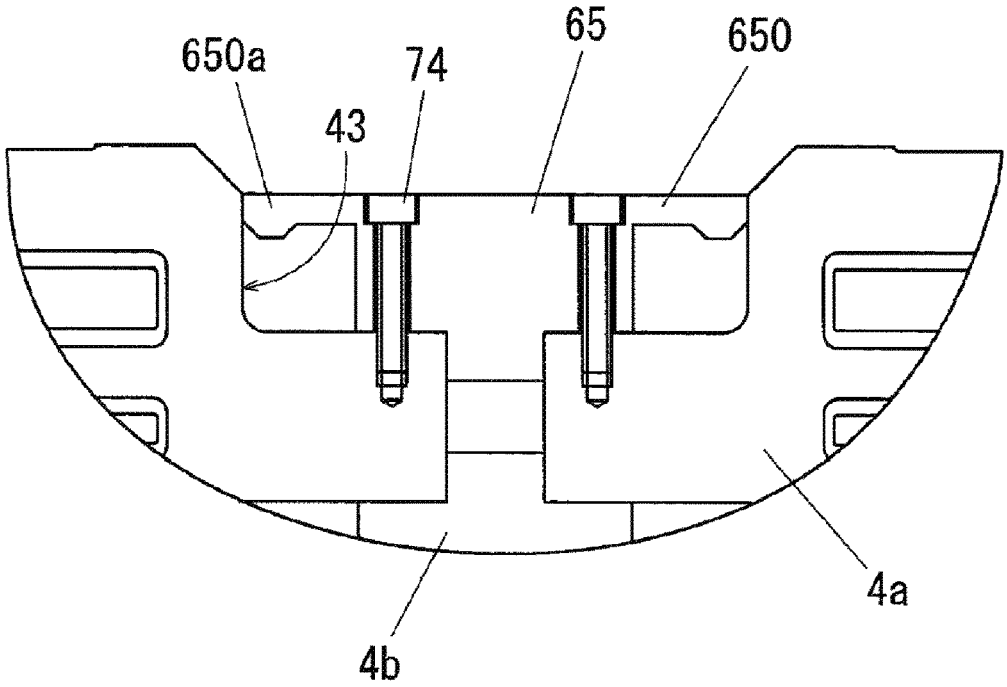
FIGS. 9A and 9B are views of a fifth variation of the present embodiment.
Figure 9B:
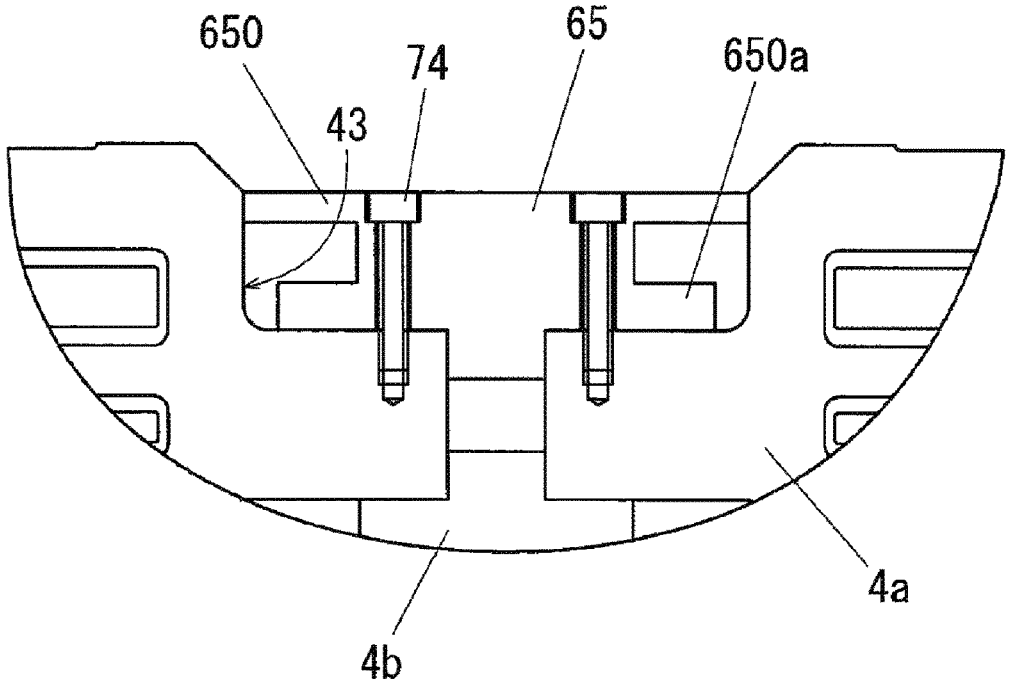

FIGS. 9A and 9B are views of a fifth variation of the present embodiment. In the above-described example illustrated in FIG. 2, two components of the balance ring 5 and the cover portion form the balance correction member 65. On the other hand, in a configuration illustrated in FIG. 9A, a single component forms the balance correction member 65. The balance correction member 65 includes a cover portion 650, and the outer-peripheral-side thickness of the cover portion 650 is increased to form a correction portion 650*a*.

In the fifth variation, the balance correction member 65 has the balance correction function and the cover portion function. Thus, the number of steps of an assembly process can be reduced as compared to the case of including two components as in FIG. 2. Further, in the balance adjustment process, balance correction is performed only once after integration of the pump rotor 4*a*, the shaft 4*b*, and the balance correction member 65.

A configuration illustrated in FIG. 9B shows the case where the correction portion 650*a* for balance correction is disposed on the inside of the recessed portion 43 covered with the cover portion 650. In the case of this configuration, a through-hole of the correction portion 650*a* needs to be formed at the cover portion 650 in balance correction, and the configuration with two components is preferable.

Note that in examples illustrated in FIGS. 9A and 9B, it is configured such that the balance correction member 65 is fixed to the pump rotor 4*a* with bolts 74. However, as in the case of the configuration of FIG. 2, the pump rotor 4*a*, the shaft 4*b*, and the balance correction member 65 may be fastened together using bolts.

(Sixth Variation)

Figure 10A:
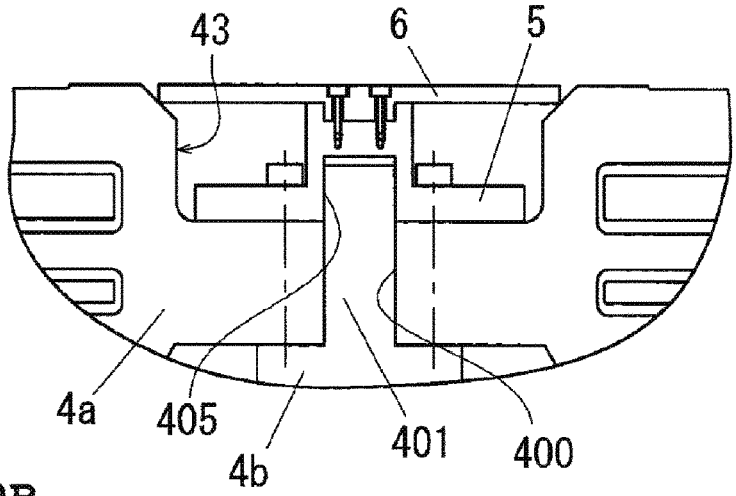
FIGS. 10A to 10C are views of a sixth variation of the present embodiment.

FIGS. 10A to 10C and FIGS. 11A and 11B are views of a sixth variation of the present embodiment. In the sixth variation, the boss portion 401 of the shaft 4*b* is configured to penetrate the through-hole 400 of the pump rotor 4*a* as illustrated in FIG. 10A. In a configuration illustrated in FIG. 10A, a tip end of the boss portion 401 protruding toward the recessed portion 43 is fitted into the recessed portion 505 formed at the balance ring 5. The configuration of the cover portion 6 is similar to that illustrated in FIG. 5.

Figure 10B:
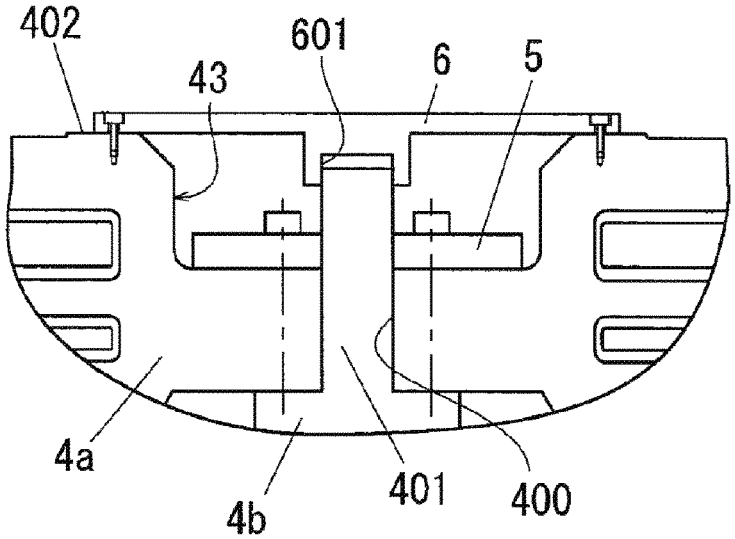

In a configuration illustrated in FIG. 10B, the balance ring 5 is a simple ring-shaped plate member, and the boss portion 401 of the shaft 4*b* penetrates a center portion of the balance ring 5. Moreover, it is configured such that the cover portion 6 is fixed to the end surface 402 of the pump rotor 4*a*, and an outer peripheral portion of the cover portion 6 is bolted to the end surface 402 of the pump rotor 4*a*. It is configured such that the recessed portion 601 formed at the center of the cover portion 6 on the back side thereof is fitted onto a tip end of the shaft 4*b*.

Figure 10C:
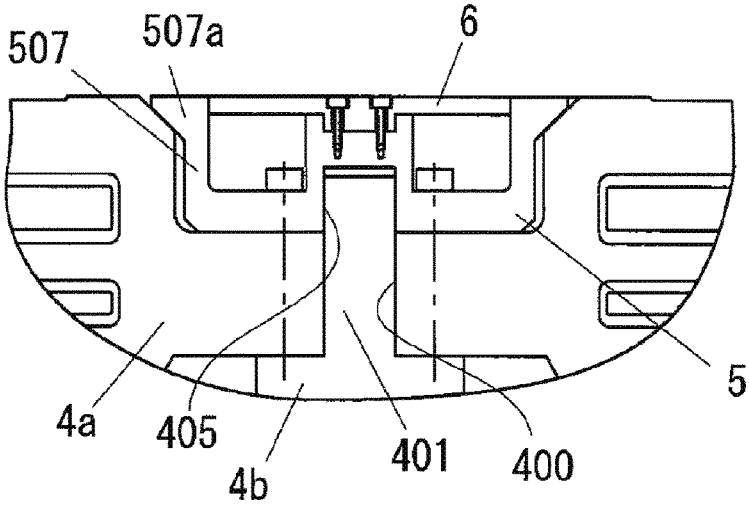

A configuration illustrated in FIG. 10C is made such that the boss portion 401 of the shaft 4*b* penetrates the through-hole 400 of the pump rotor 4*a* in the configuration of FIG. 8. The cover portion 6 has the same shape as that in the case illustrated in FIG. 8, and the configuration of the balance ring 5 is substantially similar to that in the case illustrated in FIG. 8. Note that the boss portion 401 of the shaft 4*b* penetrates the pump rotor 4*a*, and therefore, the recessed portion 405 is formed on the back side of the balance ring 5 and the tip end of the shaft 4*b* is fitted into the recessed portion 405.

Figure 11A:
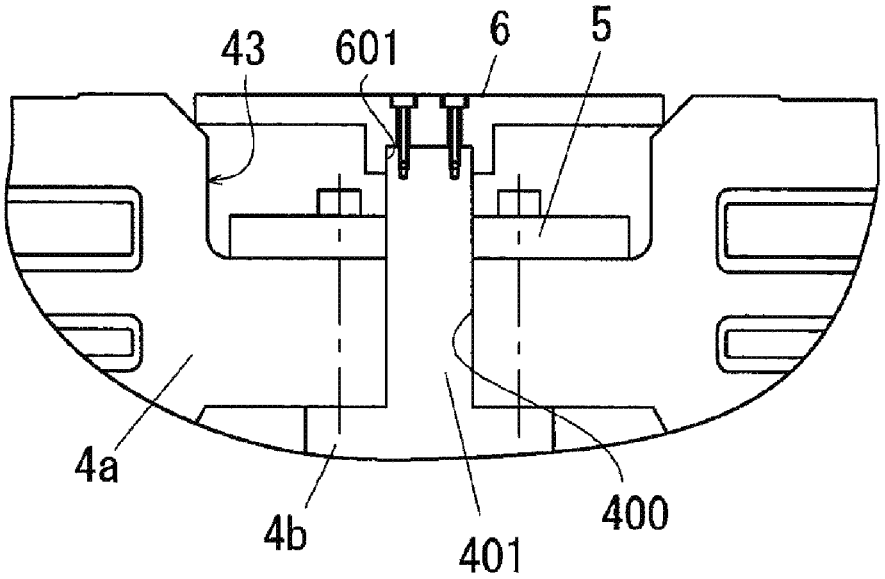
FIGS. 11A and 11B are views of another example of the sixth variation of the present embodiment.
Figure 11B:
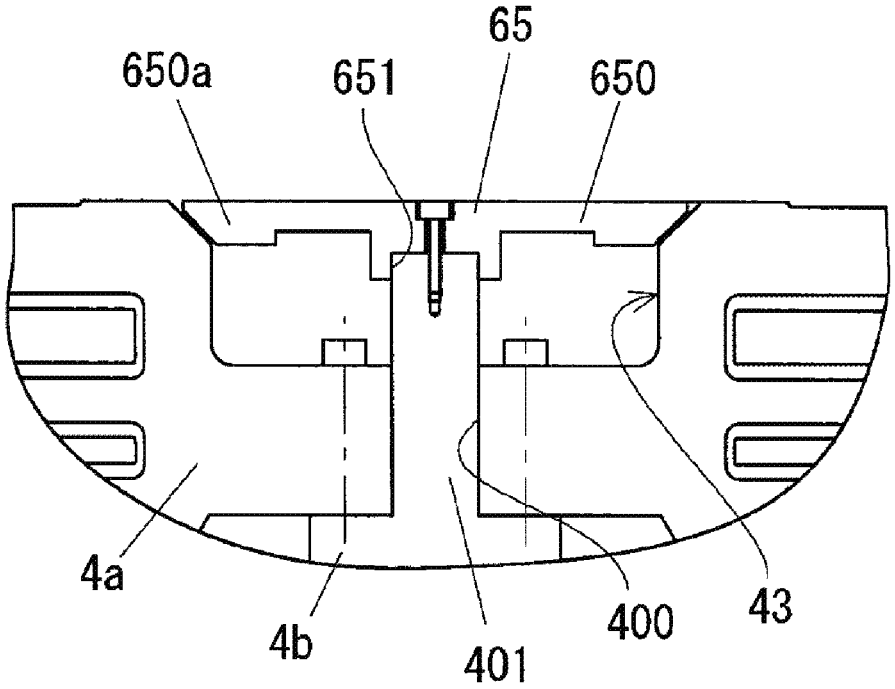

A configuration illustrated in FIG. 11A is made such that the cover portion 6 is fixed to the tip end of the boss portion 401 of the shaft 4*b* in the configuration illustrated in FIG. 10B. Moreover, a configuration illustrated in FIG. 11B is made such that the balance correction member 65 having the balance correction function and the cover portion function is fixed to the tip end of the boss portion 401 of the shaft 4*b*. The pump rotor 4*a* is bolted to the shaft 4*b*, and the balance correction member 65 is bolted to the tip end of the boss portion 401. A recessed portion 651 to be fitted onto the boss portion 401 is formed at the center of the balance correction member 65 on a back side thereof, and an outer peripheral portion of the cover portion 650 is provided with the thick correction portion 650*a*. The balance adjustment process is performed after the pump rotor 4*a* and the shaft 4*b* have been fastened together and the balance correction member 65 has been fixed to the tip end of the shaft 4*b*. In balance correction, a portion of the correction portion 650*a* of the balance correction member 65 is cut off.

As described above, the present embodiment provides the following features and advantageous effects.

(1) As illustrated in FIG. 2 and FIGS. 9A and 9B, the turbo-molecular pump 1 includes the balance correction member 65 having the cover portion 6 configured to cover the recessed portion 43. As a result, this can prevent the particles P flowing into the pump from dropping onto the end surface 402 and the outer surface 602 of the cover portion 6 and accumulating in the recessed portion 43. The particles P on the end surface 402 and the outer surface 602 move in the direction toward the rotor blade 41 due to the centrifugal force, and then, are exhausted toward the pump downstream side. This can prevent accumulation of the particles P on the pump rotor end surface, and can prevent rebounding of the particles P into the semiconductor device chamber due to the increased/decreased pressure of the chamber.

(2) As illustrated in FIGS. 4A and 4B, the rotor-axial position of the cover portion 6 is set between the position (the position illustrated in FIG. 4A) at which the outer surface 602 of the cover portion 6 is coincident with the edge of the inner wall 431 of the recessed portion 43 and the position (the position illustrated in FIG. 4B) at which the inner surface 604 of the cover portion 6 is coincident with the suction-port-side end surface 402 of the pump rotor 4*a*. When the inclined surface 403 having an ascending gradient and connecting between the edge of the inner wall 431 of the recessed portion 43 and the suction-port-side end surface 402 of the pump rotor 4*a* is provided, the edge of the inner wall 431 as the lower position limit within a set area is the line of intersection between the inclined surface 403 and the inner wall 431.

Since the rotor-axial position of the cover portion 6 is set as described above, the particles P on the outer surface 602 of the cover portion 6 can easily move in the direction toward the rotor blade due to the centrifugal force. For example, when the outer surface 602 of the cover portion 6 is positioned lower than the edge of the inner wall 431, the particles P moving on the outer surface 602 are held back by the inner wall 431, and accumulate at such a portion. On the other hand, in the present embodiment, the lower position limit of the outer surface 602 is the edge of the inner wall 431, and therefore, such accumulation of the particles P can be prevented. Moreover, the vertical inner wall 431 is not exposed, and therefore, wiping of the particles P on the outer surface 602 is facilitated upon pump maintenance.

(3) As illustrated in FIG. 2, the balance correction member 65 includes two components of the balance ring 5 and the cover portion 6 arranged in the recessed portion 43, and therefore, the balance correction process by the balance ring 5 is facilitated. Moreover, a material suitable for each component can be used. For example, metal with a great specific gravity is used for the balance ring 5, and a metal material with a small specific gravity is used for the cover portion 6.

(4) As illustrated in FIG. 5, the correction portion 603 for balance correction is also provided at the cover portion 6, and therefore, there is an extra amount of a correctable margin in balance correction after attachment of the cover portion 6.

(5) In the configuration illustrated in FIG. 8, the balance ring 5 includes the correction portion 507*a* disposed on the outer peripheral side of the cover portion 6 to cover a portion of the recessed portion 43 and having the cover function and the balance correction function. With such a configuration, balance correction can be performed by the correction portion 507*a* in any of balance correction before attachment of the cover portion 6 and after attachment of the cover portion 6. As described above, the component (the balance ring 5) for the balance correction function and the component (the cover portion 6) for the cover function are provided as precisely-separated components, and therefore, the configuration dedicated to each function can be provided. For example, the thickness and weight of the cover portion 6 can be reduced as much as possible.

(6) As illustrated in FIG. 2, it is configured such that the balance ring 5, the pump rotor 4*a*, and the shaft 4*b* are fastened together with the bolts 70, and therefore, the number of assembly processes can be reduced.

(7) As illustrated in FIG. 5, a communication path (the clearance G) connecting between the recessed portion 43 and the external space of the cover portion 6 is provided, and therefore, gas in the recessed portion 43 is promptly exhausted upon vacuum pumping. As a result, the situation is not caused, in which the adverse effect on the vacuum environment is caused due to gradual leakage of gas from the recessed portion 43.

Various embodiment and variations have been described above, but the present invention is not limited to the contents of these embodiment and variations. Moreover, one or more of the above-described variations can be combined with the above-described embodiment. Further, other aspects conceivable within the scope of the technical idea of the present invention are included in the scope of the present invention. For example, the turbo-molecular pump has been described as an example in the above-described embodiment. However, the present invention is also applicable to a vacuum pump having a rotor configured to rotate at high speed, such as a molecular drag pump. The bolt for attachment of the cover portion may be in such a shape that the bolt slightly protrudes upward from the cover portion. Moreover, the balance ring and the cover may be plated for corrosion resistance. In this case, the entire surfaces of the balance ring and the cover may be plated, or only an upper surface of the cover portion exposed through the recessed portion may be plated.

What is claimed is:

1. A balance adjustment method of a vacuum pump, wherein the vacuum pump includes a pump rotor including rotor blades, a cylindrical portion, a shaft and a motor, and rotatably driven by the motor; a recessed portion formed at a suction-port-side end surface of the pump rotor; a first component configured to be fixed to the pump rotor in the recessed portion and having a first balance correction portion for correcting the balance of the pump rotor, and a second component configured to be fixed to the first component and covering the recessed portion, the second component having a second balance correction portion at a suction-port-side end surface of the second component for correcting the balance of the pump rotor, the balance adjustment method including:

a first step of fixing the first component to the bottom surface of the recessed portion of the pump rotor, a second step of measuring an unbalance amount of the pump rotor and correcting the balance of the pump rotor at the first balance correction portion of the first component before the second component is fixed to the pump rotor via the first component, and unbalance amount of the pump rotor and correcting the balance of the pump rotor at the second balance correction portion of the second component after the second component is fixed to the pump rotor via the first component.

2. The balance adjustment method according to claim 1, wherein the pump rotor has an inclined surface having an ascending gradient and connecting between the edge of the inner wall of the recessed portion and the suction-port-side end surface of the pump rotor.

3. The balance adjustment method according to claim 1, wherein the first component includes a third correction portion disposed on an outer peripheral side of the second component to cover a portion of the recessed portion and having both of a cover function and a balance correction function.

4. The balance adjustment method according to claim 1, wherein the first component, the pump rotor, and the shaft are fastened together with a bolt.

5. The balance adjustment method according to claim 1, wherein the shaft penetrates the pump rotor to protrude into the recessed portion, and the rotor balance correction member is fixed to a portion of the shaft protruding into the recessed portion.

6. The balance adjustment method according to claim 1, wherein the shaft penetrates the pump rotor to protrude into the recessed portion, and the second component is fixed to a portion of the shaft protruding into the recessed portion.

7. The balance adjustment method according to claim 1, further comprising:

a communication path connecting between the recessed portion and an external space of the cover portion.

8. The balance adjustment method according to claim 1, wherein the correcting the balance of the pump rotor at the first balance correction portion includes cutting off at least part of the first balance correction portion of the first component.

9. The balance adjustment method according to claim 1, wherein the correcting the balance of the pump rotor at the second balance correction portion includes cutting off at least part of the second balance correction portion of the second component.

10. The balance adjustment method according to claim 1, wherein a rotor-axial position of the second component is set between a position at which an outer surface of the second component is coincident with an edge of an inner wall of the recessed portion and a position at which an inner surface of the second component is coincident with the suction-port-side end surface of the pump rotor.

* * * * *